US010507149B2

(12) United States Patent
Bai

(10) Patent No.: US 10,507,149 B2
(45) Date of Patent: Dec. 17, 2019

(54) NURSING BED AND CONTROL METHOD THEREOF

(71) Applicant: BOE TECHNOLOGY GROUP CO., LTD., Beijing (CN)

(72) Inventor: Jinglu Bai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 571 days.

(21) Appl. No.: 15/305,208

(22) PCT Filed: Oct. 16, 2015

(86) PCT No.: PCT/CN2015/092092
§ 371 (c)(1),
(2) Date: Oct. 19, 2016

(87) PCT Pub. No.: WO2016/184023
PCT Pub. Date: Nov. 24, 2016

(65) Prior Publication Data

US 2017/0156956 A1 Jun. 8, 2017

(30) Foreign Application Priority Data

May 19, 2015 (CN) ..... 2015 1 0254906

(51) Int. Cl.
*A61G 7/018* (2006.01)
*A47C 19/02* (2006.01)
(Continued)

(52) U.S. Cl.
CPC ..... *A61G 7/018* (2013.01); *A47C 19/025* (2013.01); *A47C 27/082* (2013.01);
(Continued)

(58) Field of Classification Search
CPC ..... A61G 7/018; A47C 27/083; G08B 21/182
See application file for complete search history.

(56) References Cited

U.S. PATENT DOCUMENTS 6,115,860 A * 9/2000 Vrzalik ..... A61G 7/001 5/710
2009/0119841 A1* 5/2009 Takashima ..... A61B 5/11 5/600

(Continued)

FOREIGN PATENT DOCUMENTS

CN 2421977 Y 3/2001
CN 1957871 A 5/2007

(Continued)

OTHER PUBLICATIONS

Chinese First Office Action for Chinese Application No. 201510254906.0, dated Sep. 30, 2016, 7 Pages.

(Continued)

*Primary Examiner* — Eric J Kurilla
(74) *Attorney, Agent, or Firm* — Brooks Kushman P.C.

(57) ABSTRACT

A nursing bed including a bed body, provided with a plurality of combined bed boards, at least one of the plurality of combined bed boards being provided with one or more pressure sensors, and a comparator, connected to the one or more pressure sensors. The comparator is configured to compare pressure data transmitted by the one or more pressure sensors with a predetermined pressure value and output a warning signal when the pressure data transmitted by the one or more pressure sensors is greater than or equal to the predetermined pressure value. A timer, is connected to the comparator, and with respect to each of the pressure sensors, configured to start timing when the warning signal is received and output an alarm signal when a preset time is reached, and an alarm device, is connected to the timer, and configured to give an alarm after the alarm signal is received.

18 Claims, 7 Drawing Sheets

(51) Int. Cl.

| | |
|---|---|
| ***A47C 27/08*** | (2006.01) |
| ***A61G 7/00*** | (2006.01) |
| ***A61G 7/008*** | (2006.01) |
| ***A61G 7/015*** | (2006.01) |
| ***A61G 7/057*** | (2006.01) |
| ***G08B 21/18*** | (2006.01) |

(52) U.S. Cl.

CPC ..... *A47C 27/083* (2013.01); *A61G 7/001* (2013.01); *A61G 7/008* (2013.01); *A61G 7/015* (2013.01); *A61G 7/0573* (2013.01); *A61G 7/05715* (2013.01); *A61G 7/05769* (2013.01); *A61G 7/05784* (2016.11); *G08B 21/182* (2013.01); *A61G 2203/20* (2013.01); *A61G 2203/34* (2013.01)

(56) References Cited

U.S. PATENT DOCUMENTS

2012/0277637 A1* 11/2012 Vahdatpour ..... A47C 31/123 600/595

2015/0351982 A1* 12/2015 Krenik ..... A47C 23/06 5/616

FOREIGN PATENT DOCUMENTS

| | | | |
|---|---|---|---|
| CN | 201200565 | Y | 3/2009 |
| CN | 201558246 | U | 8/2010 |
| CN | 101856293 | A | 10/2010 |
| CN | 102247251 | A | 11/2011 |
| CN | 102499832 | A | 6/2012 |
| CN | 202631987 | U | 12/2012 |
| CN | 103238152 | A | 8/2013 |
| CN | 104523387 | A | 4/2015 |
| CN | 104800019 | A | 7/2015 |
| CN | 204798204 | U | 11/2015 |
| WO | 03096957 | A1 | 11/2003 |
| WO | 2007106040 | A1 | 9/2007 |

OTHER PUBLICATIONS

International Search Report and Written Opinion for Application No. PCT/CN2015/092092, dated Feb. 14, 2016, 13 Pages.

* cited by examiner

NURSING BED AND CONTROL METHOD THEREOF

CROSS-REFERENCE TO RELATED APPLICATIONS

This application is the U.S. national phase of PCT Application No. PCT/CN2015/092092 filed on Oct. 16, 2015, which claims priority to Chinese Patent Application No. 201510254906.0 filed on May 19, 2015, the disclosures of which are incorporated in their entirety by reference herein.

TECHNICAL FIELD

The present disclosure relates to the technical field of the medical care, in particular to a nursing bed and a control method thereof

BACKGROUND

For patients that need to stay in bed for a long time, patients need to turn over with the aid of nurses regularly (e.g. once every two hours) in order to reduce the likelihood of suffering from the bedsore. However, since the patients' conditions are different, the medical care manner of turning over the patients every two hours may not be suitable for all the patients. Therefore, it is difficult for the nurses to accurately determine the best time for each of the patients to turn over, which brings about great inconveniences for the nursing work.

SUMMARY

In view of that, the present disclosure provides a nursing bed and a control method thereof in order to monitor the pressure on the body tissue of a bedridden patient and alarm when the borne pressure meets an alarm condition.

To achieve the above object, the present disclosure provides a nursing bed, which includes a bed body, provided with a plurality of combined bed boards, at least one of the plurality of combined bed boards is provided with one or more pressure sensors; a comparator, connected to the one or more pressure sensors, and configured to compare pressure data transmitted by the one or more pressure sensors with a predetermined pressure value and output a warning signal when the pressure data transmitted by the one or more pressure sensors is greater than or equal to the predetermined pressure value; a timer, connected to the comparator, and with respect to each of the pressure sensors, configured to start timing when the warning signal is received and output an alarm signal when a preset time is reached; and an alarm device, connected to the timer, and configured to give an alarm after the alarm signal is received.

In some embodiments, the comparator outputs a normal indication signal when the pressure data is less than the predetermined pressure value, and the timer stops timing after receiving the normal indication signal.

In some embodiments, the plurality of combined bed boards is detachably provided on the bed body.

In some embodiments, the bed body includes a frame and a plurality of slats fixed on the frame and arranged in a parallel and spaced manner, the combined bed boards are detachably provided on the slats.

In some embodiments, the plurality of combined bed boards is arranged in a matrix manner.

In some embodiments, the nursing bed further includes a plurality of liftable rods, corresponding to the plurality of combined bed boards in a one-to-one correspondence relation, and each of the plurality of liftable rods is fixed at a lower surface of the corresponding combined bed board; a combined bed board controller, connected to the comparator, and configured to determine the combined bed board corresponding to the warning signal upon receiving the warning signal and generate a moving downward control signal; and a combined bed board driving motor, connected to the liftable rods and the combined bed board controller, and configured to drive a liftable rod of the combined bed board that corresponds to the warning signal to move downward according to the moving downward control signal.

In some embodiments, the combined bed board controller further includes a moving upward control signal generation module, the moving upward control signal generation module is configured to generate a moving upward control signal, and the combined bed board driving motor drives a liftable rod of a combined bed board has moved downward to move upward after receiving the moving upward control signal so as to restore flatness of a surface of the bed body.

In some embodiments, the nursing bed further includes a first movable board and a second movable board, rotatably connected to a left side and a right side of the bed body respectively; a first liftable support and a second liftable support, connected to the first movable board and the second movable board respectively; a turning over controller, connected to the comparator and configured to generate a left side turning over control signal or a right side turning over control signal upon receiving the warning signal; and a turning over driving motor, connected to the first liftable support, the second liftable support and the turning over controller, and configured to control the first movable board to move upward upon receiving the left side turning over control signal and control the second movable board to move upward upon receiving the right side turning over control signal.

In some embodiments, the combined bed board is provided with a vent port, and the nursing bed further includes an air passage, which is provided under the combined bed board; a blower, which is connected to the air passage; and a blower controller, which is connected to the comparator and the blower, and is configured to control the blower to be started upon receiving the warning signal.

In some embodiments, the nursing bed further includes a blade, mounted on the vent port; a blade controller, connected to the comparator and configured to determine a combined bed board corresponding to the warning signal upon receiving the warning signal and generate a blade starting control signal; and a blade driving motor, connected to the blade controller and the blade, and configured to control a blade of a combined bed board that corresponds to the warning signal to be opened based on the blade starting control signal.

In some embodiments, the nursing bed further includes a setter, which is connected to the comparator, and is configured to set the predetermined pressure value and the preset time.

In some embodiments, the setter includes input keys and an input display interface, the predetermined pressure value and the preset time are input by the input keys, the input predetermined pressure value and the input preset time are displayed by the input display interface.

In some embodiments, the plurality of combined bed boards is in a same size and in a rectangular shape.

In some embodiments, the plurality of combined bed boards is in a diamond shape, and the plurality of combined bed boards takes up a portion of the whole surface of the nursing bed.

In some embodiments, the pressure sensor is provided on a film carrier, which is detachably provided on the combined bed board.

In some embodiments, each of the combined bed boards is provided with at least one pressure sensor.

The present disclosure further provides a control method of a nursing bed, which is applied to the above nursing bed. The method includes steps of: comparing the pressure data transmitted by the pressure sensors with the predetermined pressure value and outputting the warning signal when the pressure data transmitted by the pressure sensors is greater than or equal to the predetermined pressure value; with respect to each of the pressure sensors, starting timing when the warning signal is received and outputting an alarm signal when the preset time is reached; and alarming after the alarm signal is received.

In some embodiments, the step of comparing pressure data transmitted by pressure sensors with the predetermined pressure value and outputting a warning signal when the pressure data transmitted by the pressure sensors is greater than or equal to the predetermined pressure value further includes outputting a normal indication signal when the pressure data is less than the predetermined pressure value.

In some embodiments, the step of with respect to each of the pressure sensors, starting timing when the warning signal is received and outputting an alarm signal when the preset time is reached further comprises stopping timing upon receiving the normal indication signal.

The above technical solution of the present disclosure has the beneficial effects as follows. The pressure on the body tissue of a bedridden patient can be monitored, and when a time period during which the borne pressure is greater than or equal to the predetermined pressure value reaches the preset time, alarming is performed, in order to remind the nurses to turn over the patient so that they can accurately determine the best time for each of the patients to turn over, thereby reducing the likelihood of suffering from the bedsore.

DETAILED DESCRIPTION

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed, too.

The present disclosure will be described hereinafter in conjunction with the drawings and embodiments. The following embodiments are for illustrative purposes only, but shall not be used to limit the scope of the present disclosure.

Figure 1:
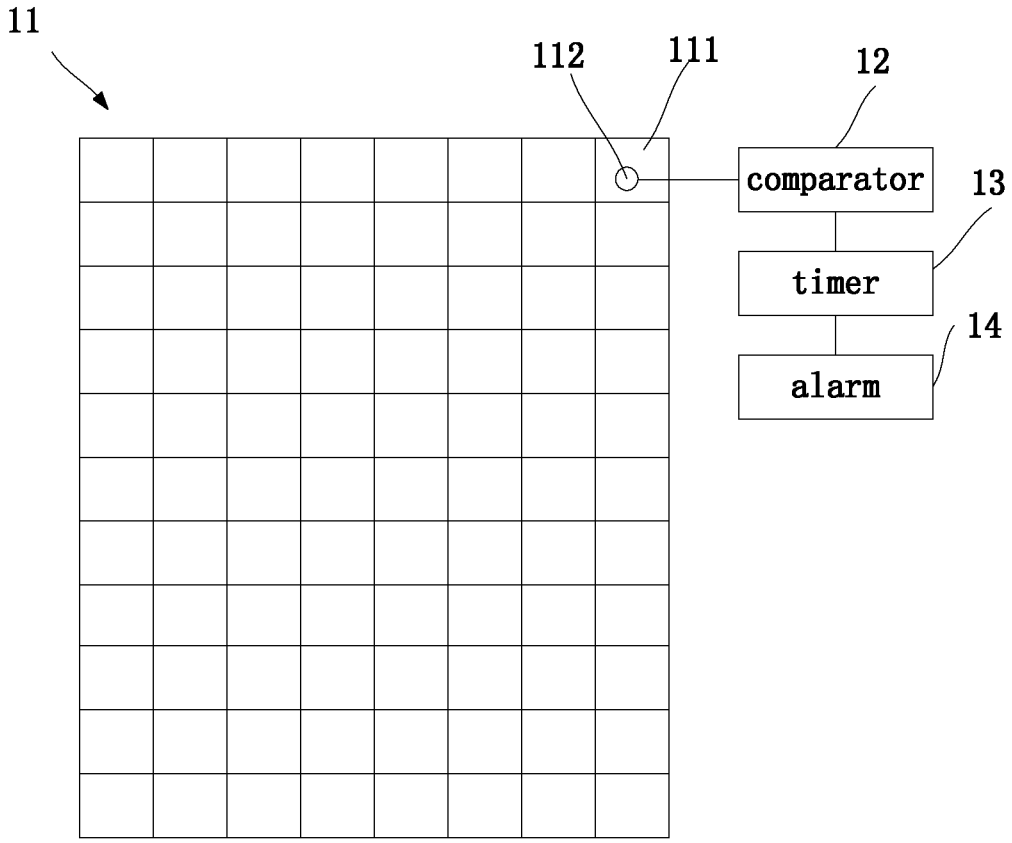
FIG. 1 is a schematic view showing a nursing bed according to at least one embodiment of the present disclosure.

FIG. 1 is a schematic view showing a nursing bed according to at least one embodiment of the present disclosure. The nursing bed includes a bed body 11, a comparator 12, a timer 13 and an alarm 14.

Specifically, the bed body 11 includes a plurality of combined bed boards 111, one or more pressure sensors 112 are provided on at least one combined bed board. For example, each of the combined bed boards is provided with one pressure sensor. FIG. 1 only shows a pressure sensor 112 on one combined bed board 111.

The comparator 12 is connected to the pressure sensor 112, and is configured to compare pressure data transmitted by the pressure sensor 112 with a predetermined pressure value, and output a warning signal when the pressure data transmitted by the pressure sensor 112 is greater than or equal to the predetermined pressure value. The comparator 12 may be connected to pressure sensors on respective combined bed boards, or can be connected to pressure sensors on a part of the combined bed boards 111.

In some embodiments, when the pressure data is less than the predetermined pressure value, the normal indication signal is output.

The timer 13 is connected to the comparator 12, and is configured to receive the warning signal and the normal indication signal output by the comparator. For each of the pressure sensors 112, the timer starts when the warning signal is received and an alarm signal is output when a preset time is reached. If the normal indication signal is received during the timing process, the timer stops.

The alarm 14 is connected to the timer 13, and is configured to give an alarm after receiving the alarm signal.

In at least one embodiment of the present disclosure, the pressure sensors are provided on the combined bed boards in order to monitor the pressure that the body tissue of a patient in bed bears. If a time period during which the pressure borne by the patient is greater than or equal to the predetermined pressure value reaches a preset time value, alarming is performed in order to remind the nurses to turn over the patient so that the nurses can accurately determine the best time for each of the patients to turn over, thereby reducing the likelihood of suffering from the bedsore.

In embodiments of the present disclosure, the plurality of combined bed boards 111 is rectangular, and is of the same size. Of course, in other embodiments of the present disclosure, the combined bed boards can be in other shapes, and the bed body may be formed by a plurality of combined bed boards having different sizes.

Figure 2:
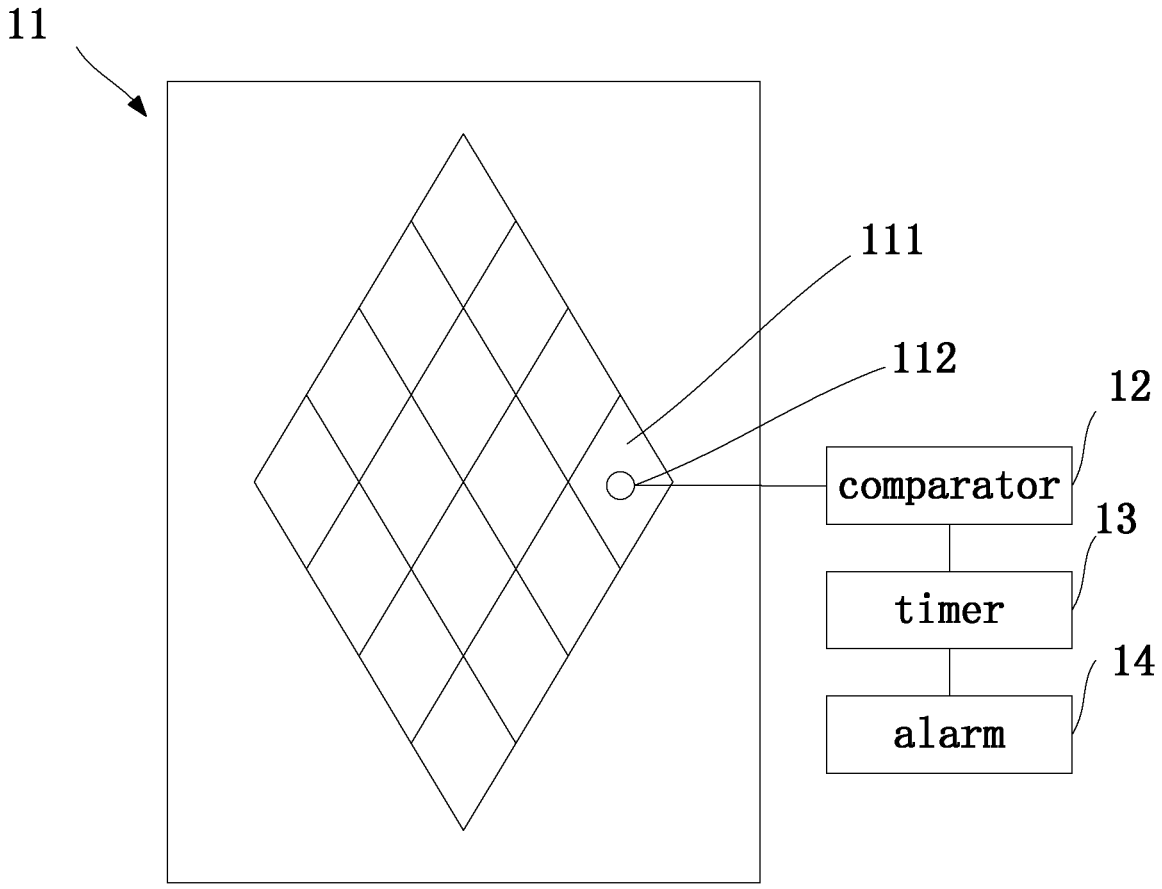
FIG. 2 is another schematic view showing a nursing bed according to at least one embodiment of the present disclosure.

FIG. 2 is another schematic view showing a nursing bed according to at least one embodiment of the present disclosure. In this embodiment, the combined bed boards 111 are in a shape of a diamond, and the plurality of combined bed boards 111 only takes up a portion of the whole bed surface of the bed body 11, while in the above embodiment, the combined bed boards 111 form an entire bed surface of the bed body 11.

Figure 3:
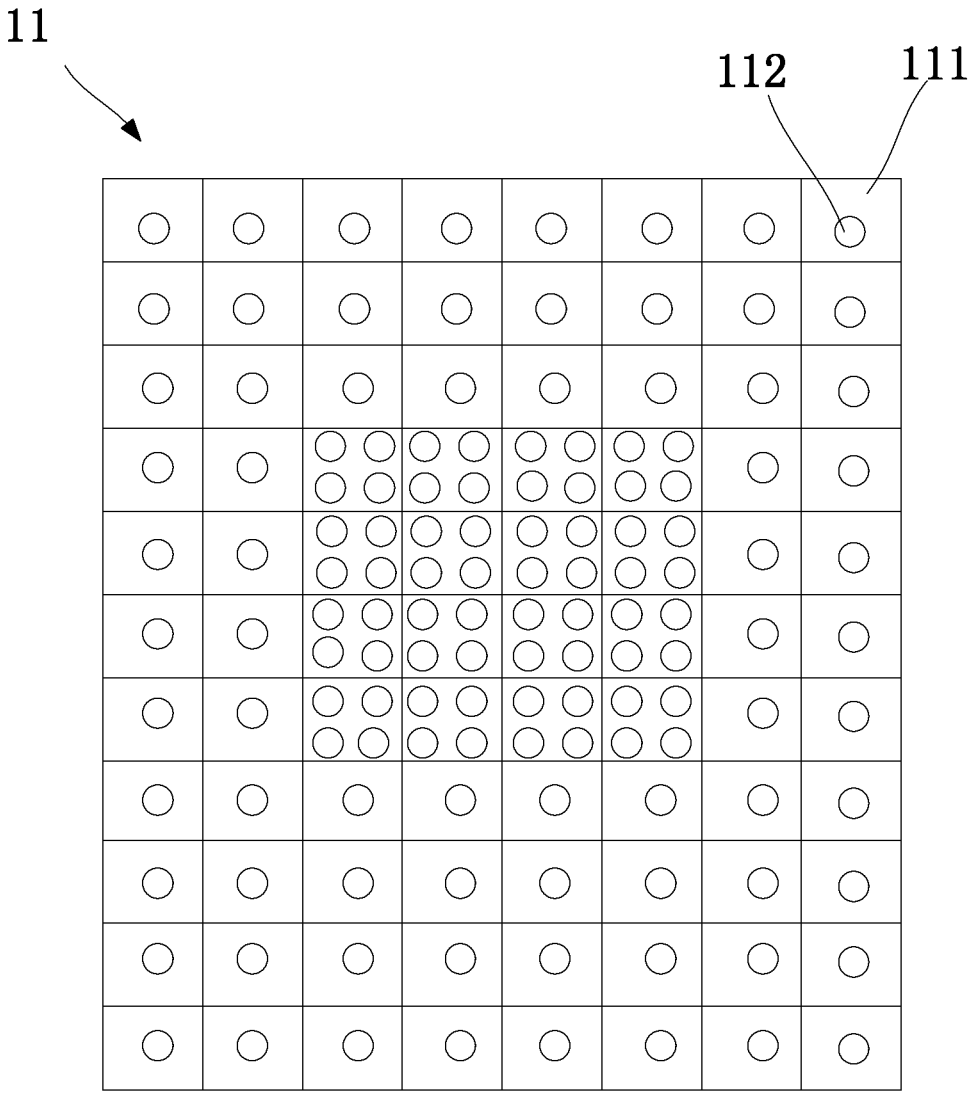
FIG. 3 is yet another schematic view showing a nursing bed according to at least one embodiment of the present disclosure.

In the embodiment of the present disclosure, the number of the pressure sensors 112 provided on different combined bed boards 111 may be identical or different. Referring to FIG. 3, in this embodiment, a relatively large number of pressure sensors 12 are provided on combined bed boards 111 at positions corresponding to a position region of the body tissue (such as hip and back) of the patient that bears a relatively large pressure, whereas a relatively small number of pressure sensors 12 are provided on the combined bed boards 111 at other positions.

Since different patients have different heights and/or body sizes, the body parts (such as hip and back) that bear relatively large pressures are different. If each of the combined bed boards 111 on the bed body 11 is fixed (immovable), requirements for the patients in bed having different heights and/or body sizes may not be met. Therefore, in some embodiments of the present disclosure, the plurality of combined bed boards 111 is detachably provided on the bed body 11 so that the positions of the combined bed boards 111 can be adjusted according to the specific conditions of the patients in order to meet requirements of patients in bed having different heights and/or body sizes.

Figure 4:
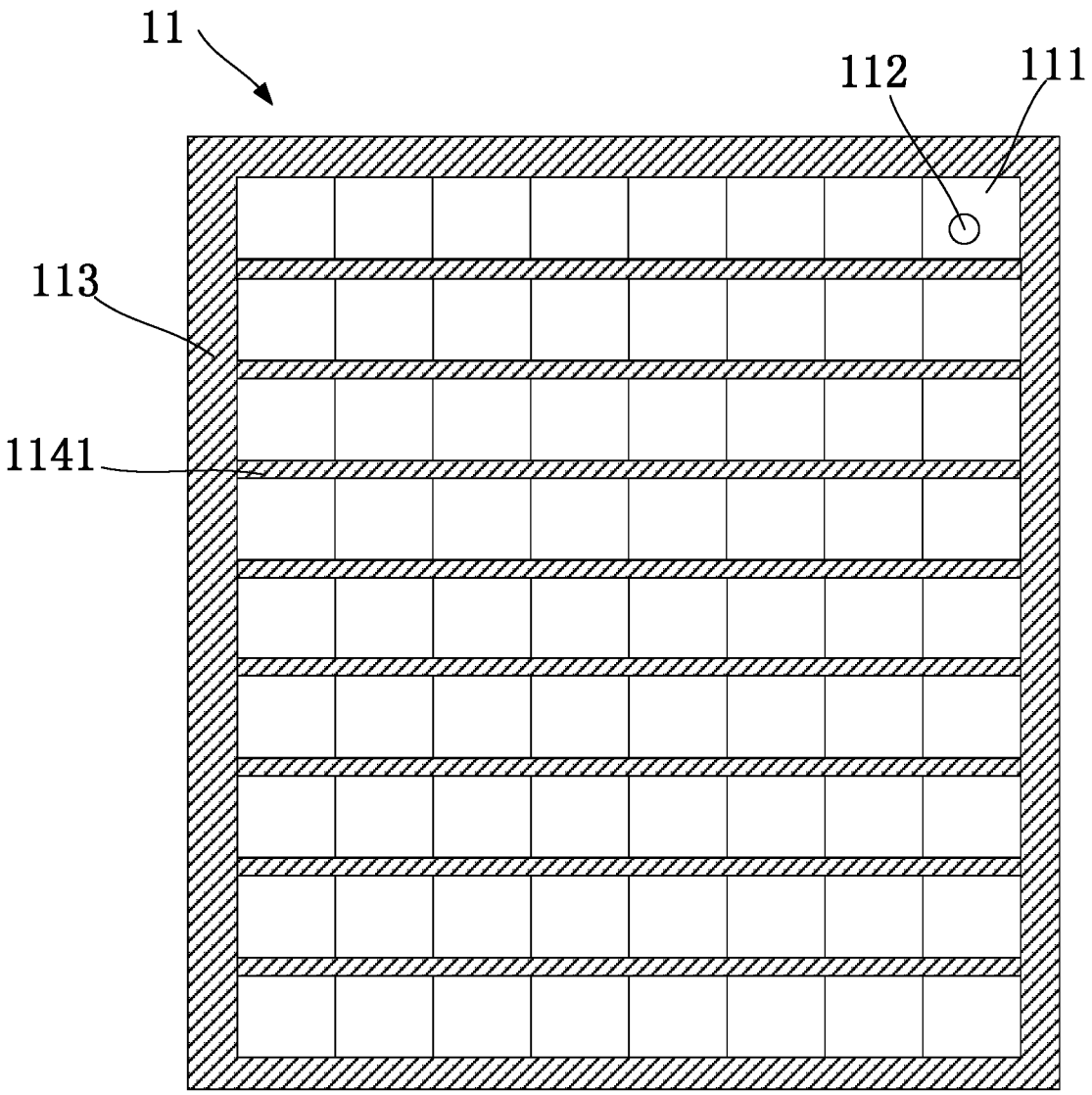
FIG. 4 is still yet another schematic view showing a nursing bed according to at least one embodiment of the present disclosure.

Referring to FIG. 4, in one embodiment of the present disclosure, the bed body 11 includes a frame 113 and a plurality of horizontal slats 1141 fixed on the frame 113 in a parallel and spaced manner, and the combined bed boards 111 are detachably provided on the horizontal slats 1141 so that the supporting strength of the bed body 11 is improved.

Figure 5:
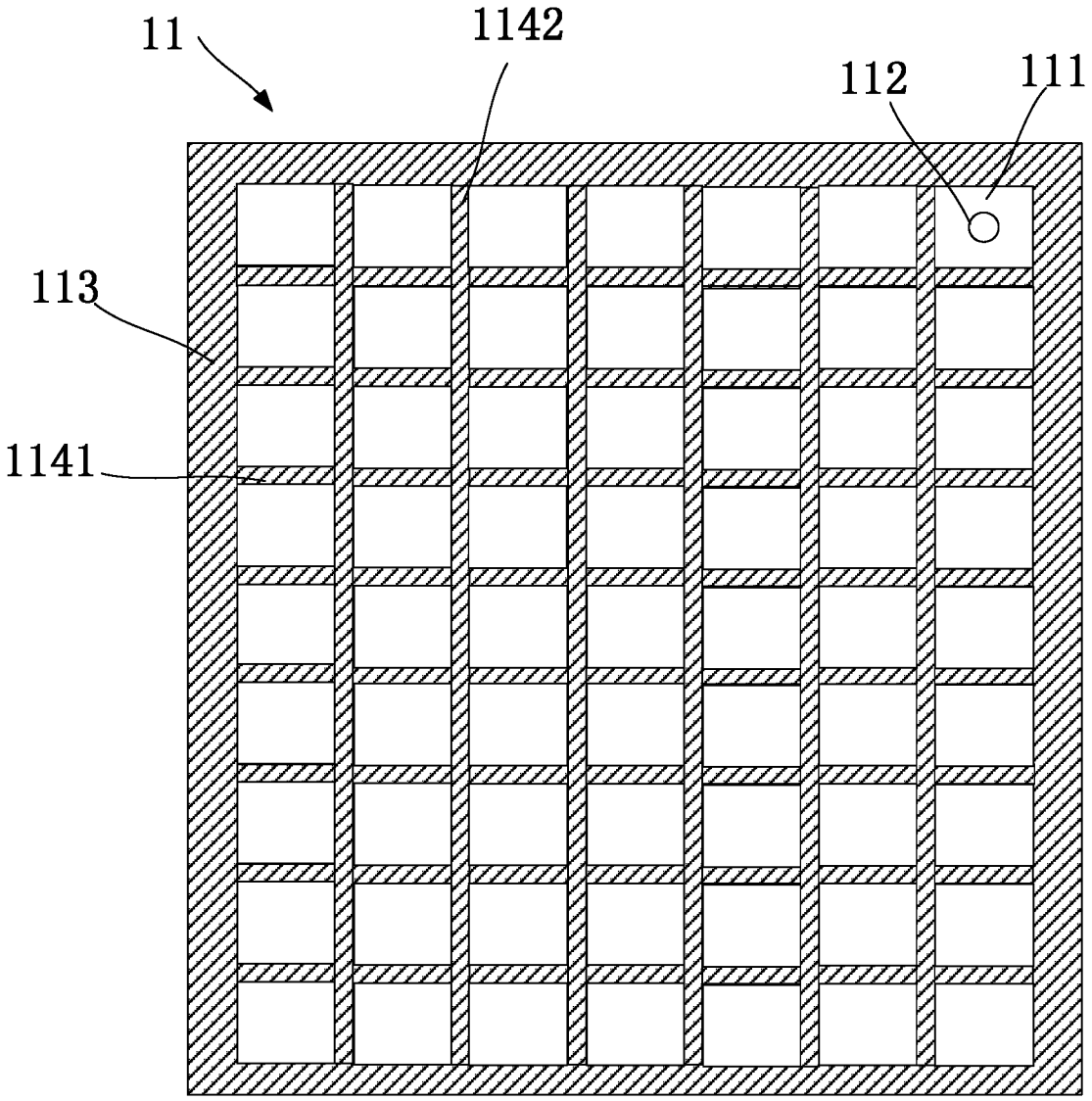
FIG. 5 is still yet another schematic view showing a nursing bed according to at least one embodiment of the present disclosure.

Referring to FIG. 5, in another embodiment of the present disclosure, the bed body 11 includes the frame 113, the plurality of horizontal slats 1141 fixed on the frame 113 in a parallel and spaced manner and a plurality of longitudinal slats 1142 fixed on the frame 113 in a parallel and spaced manner. The horizontal slats 1141 and the longitudinal slats 1142 define a plurality of window regions, and the combined bed boards 111 are detachably provided within the window regions.

In the above embodiments, the combined bed boards 111 are arranged in a matrix manner. Of course, in other embodiments of the present disclosure, the manner for arranging the plurality of combined bed boards is not limited to the matrix manner.

In the above embodiments, the pressure sensors 112 may be fixed to the combined bed board 111. Of course, the pressure sensors 112 may be detachably provided on the combined bed board 111. Specifically, the pressure sensors 112 may be provided on a film carrier, and this film carrier may be detachably provided on the combined bed boards 111. In such a structure, there is no need to move the combined bed board 111. Instead, the position of the film carrier on the combined bed board 111 is adjusted so as to meet requirements of patients having different heights and/or body sizes.

The comparator 12 in the above embodiments can be realized by means of a hardware circuit. Of course, it also can be realized by means of software. The number of the comparators 12 provided on the bed body 11 may be one or more. When one comparator is provided, it is connected to the pressure sensor 112 on each of the combined bed boards 111, receives the pressure data transmitted by each of the pressure sensors 112, and compares the pressure data with a predetermined pressure value, and outputs the warning signal when the pressure data transmitted by any pressure sensor 112 is greater than or equal to the predetermined pressure value. When a plurality of comparators 12 is provided, one comparator 12 may be correspondingly provided for the pressure sensor 112 on each of the combined bed boards 111.

The timer 13 in the above embodiments can be realized by means of a hardware circuit. Of course, it also can be realized by means of software. For each of the pressure sensors 112, the timer 13 starts upon receiving the warning signal. After that, the timer stops if the normal indication signal is received, and the timer continues if the normal indication signal is not received. The alarm signal is output when a preset time is reached.

The alarm 14 is configured to give an alarm after receiving the alarm signal. The alarm 14 may give an alarm in several manners. For example, an alarm tone is played, an alarm light is lit, or short messages are sent to a terminal (such as a mobile phone, a SmartBand and the like) of the nurse.

The comparator 12, the timer 13 and the alarm 14 may be provided on the bed body 11. The alarm 14 may not be provided on the bed body 11, and instead, it can be individually provided. For example, it may be provided at a working place of the nurse.

In embodiments of the present disclosure, different predetermined pressure values and different preset time are set for different patients. For instance, a relatively large predetermined pressure value can be set for a patient with a large weight, while a relatively small predetermined pressure value can be set for a patient with a small weight. A relatively short preset time may be set for a relatively large predetermined pressure value, and a relatively long preset time may be set for a relatively small predetermined pressure value. That is, in some embodiments, the nursing bed further includes a setter (not shown in the figures), which is connected to the comparator 12 for setting the predetermined pressure value and the preset time. Specifically, the setter includes input keys, by which the predetermined pressure value and the preset time are input, and an input display interface, by which the input predetermined pressure value and the input preset time are displayed.

Figure 6:
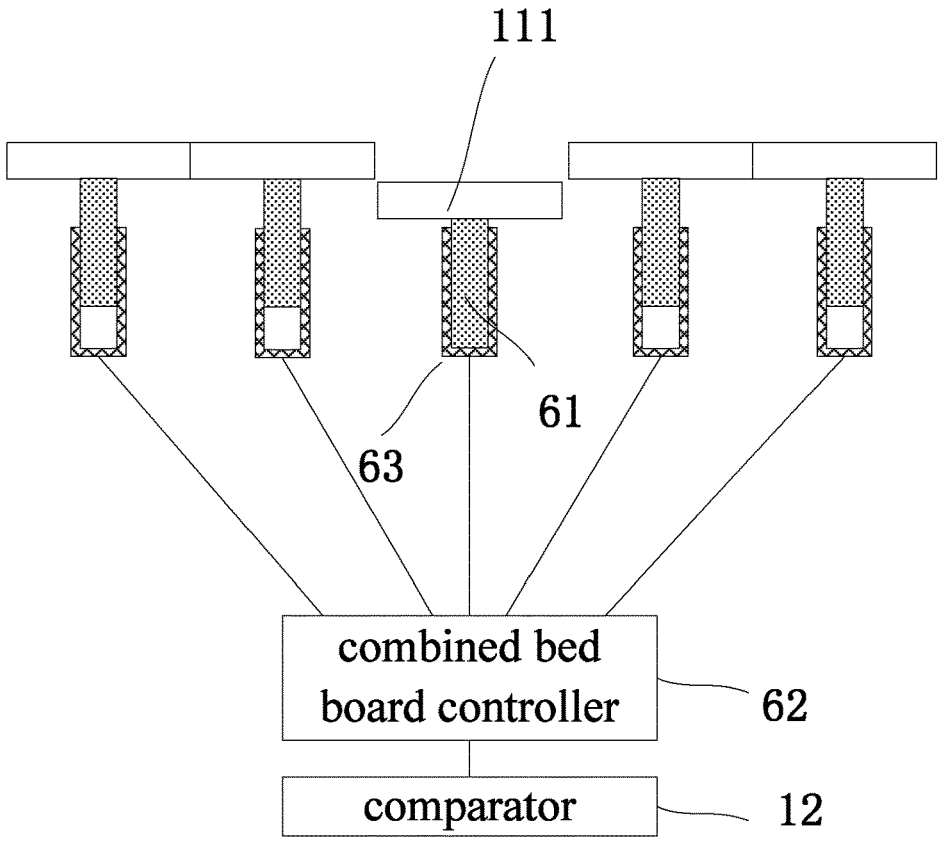
FIG. 6 is still yet another schematic view showing a nursing bed according to at least one embodiment of the present disclosure.

Referring to FIG. 6, in some embodiments of the present disclosure, the nursing bed further includes a plurality of liftable rods 61, which corresponds to the plurality of combined bed boards 111 in a one-to-one correspondence relation, and each liftable rod is fixed at a lower surface of the corresponding combined bed board 111; a combined bed board controller 62, which is connected to the comparator 12, and is configured to determine the combined bed boards 111 corresponding to the warning signal upon receiving the warning signal and generate a moving downward control signal; and a combined bed board driving motor 63, which is connected to the liftable rods 61 and the combined bed board controller 62, and is configured to drive the liftable rod 61 of the combined bed board 111 that corresponds to the warning signal to move downward according to the moving downward control signal so that the body tissue of the patient that bears a relatively large pressure do not touch the bed in order to ease the pressure on the body issue.

Of course, the combined bed board controller 62 may further include a moving upward control signal generation module, which is configured to generate a moving upward control signal, and the combined bed board driving motor 63 drives the liftable rod of the combined bed board 111 which has moved downward to move upward after receiving the moving upward control signal so as to restore the flatness of the bed surface of the bed body 11. The moving upward control signal generation module may generate the moving upward control signal after a preset time period since the combined bed board controller 62 generates the moving downward control signal, or the moving upward control signal generation module may be a control button, which is pressed manually to generate the moving upward control signal.

Figure 7:
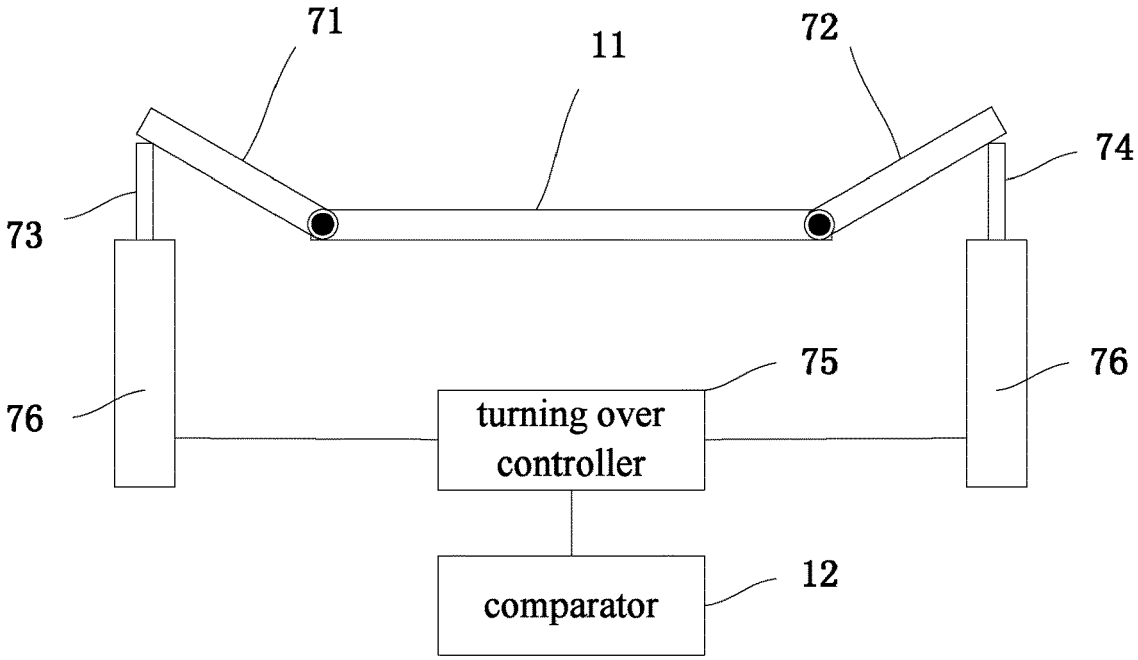
FIG. 7 is still yet another schematic view showing a nursing bed according to at least one embodiment of the present disclosure.

Referring to FIG. 7, in some embodiments of the present disclosure, the nursing bed further includes a first movable board 71 and a second movable board 72, which are rotatably connected to a left side and a right side of the bed body 11, specifically, the first movable board 71 and the second movable board 72 can be connected to the bed body 11 in a hinge manner; a first liftable support 73 and a second liftable support 74, which are connected to the first movable board 71 and the second movable board 72 respectively; a turning over controller 75, which is connected to the comparator 12 and is configured to generate a left side turning over control signal or a right side turning over control signal upon receiving the warning signal; and a turning over driving motor 76, which is connected to the first liftable support 73, the second liftable support 74 and the turning over controller 75, and is configured to control the first movable board 71 to move upward upon receiving the left side turning over control signal and control the second movable board 72 to move upward upon receiving the right side turning over control signal.

When using the nursing bed having the above structure, if a certain area of the body tissue of the patient bears a relatively large pressure, the patient can be turned over automatically in order to ease the pressure at the area.

Figure 8:
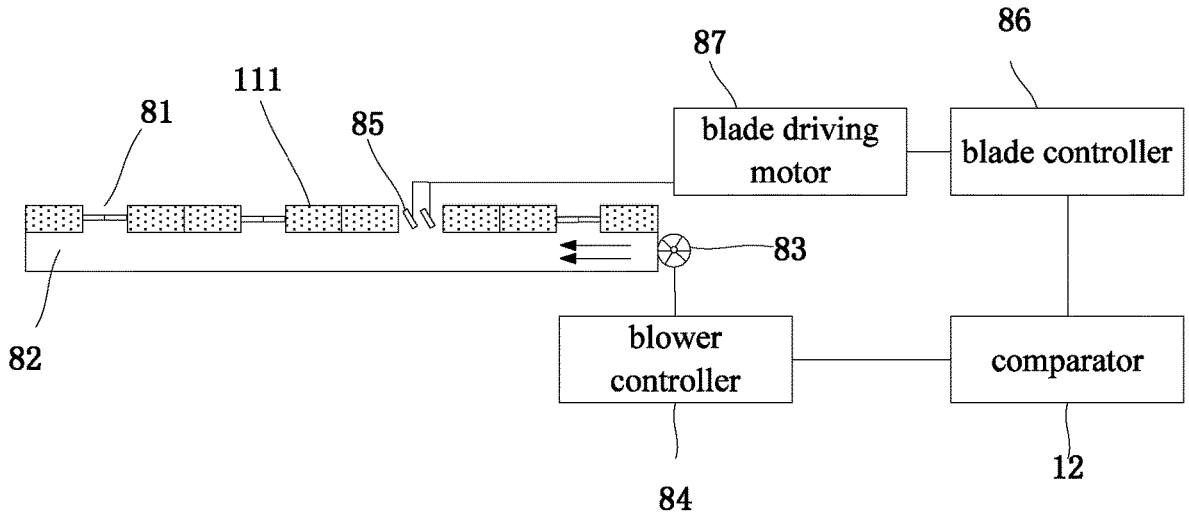
FIG. 8 is still yet another schematic view showing a nursing bed according to at least one embodiment of the present disclosure.

Referring to FIG. 8, in some embodiments of the present disclosure, the combined bed boards 111 is provided thereon with a vent port 81. The nursing bed in the embodiments of the present disclosure further includes an air passage 82, which is provided under the combined bed boards 111; a blower 83, which is connected to the air passage 82; and a blower controller 84, which is connected to the comparator 12 and the blower 83, and is configured to control the blower 83 to be started upon receiving the warning signal.

When using the nursing bed having the above structure, if a certain area of the body tissue of the patient bears a relatively large pressure, the air is delivered to the patient through the vent port 81 so that the area of the body tissue of the patient that bears the relatively large pressure is kept dry and the possibility of suffering from the bedsore is reduced.

In some embodiments, the nursing bed further includes a blade 85, which is mounted on the vent port 81; a blade controller 86, which is connected to the comparator 12, and is configured to determine the combined bed board 11 corresponding to the warning signal and generate a blade starting control signal upon receiving the warning signal; and a blade driving motor 87, which is connected to the blade controller 86 and the blade 85, and is configured to control the blade 85 on the combined bed board 11 that corresponds to the warning signal to be opened according to the blade starting control signal so that the vent port 81 of the combined bed board 11 that corresponds to the area of the patient that bears the relatively large pressure can be opened and the vent ports 81 of the combined bed boards 11 in other areas are not opened.

The embodiments of the present disclosure further disclose a control method of a nursing bed, which is applied to the nursing bed in any one of the above embodiments. The method includes steps of: Step S101: comparing pressure data transmitted by the pressure sensors with a predetermined pressure value and outputting a warning signal when the pressure data transmitted by the pressure sensors is greater than or equal to the predetermined pressure value; Step S102: with respect to each of the pressure sensors, starting timing when the warning signal is received and outputting an alarm signal when a preset time is reached; and Step S103: alarming after the alarm signal is received.

In some embodiments, Step S101 further includes outputting a normal indication signal when the pressure data is less than the predetermined pressure value.

In some embodiments, Step S102 further includes stopping timing upon receiving the normal indication signal.

The above are merely the preferred embodiments of the present disclosure. It should be noted that, a person skilled in the art may make further modifications and improvements without departing from the principle of the present disclosure, and these modifications and improvements shall also fall within the scope of the present disclosure.

What is claimed is:

1. A nursing bed, comprising:

a bed body, provided with a plurality of combined bed boards, at least one of the plurality of combined bed boards is provided with one or more pressure sensors;

a comparator, connected to the one or more pressure sensors, and configured to compare pressure data transmitted by the one or more pressure sensors with a predetermined pressure value and output a warning signal when the pressure data transmitted by the one or more pressure sensors is greater than or equal to the predetermined pressure value;

a timer, connected to the comparator, and with respect to each of the pressure sensors, configured to start timing when the warning signal is received and output an alarm signal when a preset time is reached;

an alarm device, connected to the timer, and configured to give an alarm after the alarm signal is received, a plurality of liftable rods, corresponding to the plurality of combined bed boards in a one-to-one correspondence relation, and each of the plurality of liftable rods is fixed at a lower surface of the corresponding combined bed board;

a combined bed board controller, connected to the comparator, and configured to determine the combined bed board corresponding to the warning signal upon receiving the warning signal and generate a moving downward control signal; and a combined bed board driving motor, connected to the liftable rods and the combined bed board controller, and configured to drive a liftable rod of the combined bed board that corresponds to the warning signal to move downward according to the moving downward control signal.

2. The nursing bed according to claim 1, wherein the comparator is further configured to output a normal indication signal when the pressure data is less than the predetermined pressure value, and the timer is configured to stop timing after receiving the normal indication signal.

3. The nursing bed according to claim 1, wherein the plurality of combined bed boards is detachably provided on the bed body.

4. The nursing bed according to claim 3, wherein the bed body comprises a frame and a plurality of slats fixed on the frame and arranged in a parallel and spaced manner, the combined bed boards are detachably provided on the slats.

5. The nursing bed according to claim 1, wherein the plurality of combined bed boards is arranged in a matrix manner.

6. The nursing bed according to claim 1, wherein the combined bed board controller further comprises a moving upward control signal generation module, the moving upward control signal generation module is configured to generate a moving upward control signal, and the combined bed board driving motor drives a liftable rod of a combined bed board has moved downward to move upward after receiving the moving upward control signal so as to restore flatness of a surface of the bed body.

7. The nursing bed according to claim 1, further comprising:

a setter, connected to the comparator and configured to set the predetermined pressure value and the preset time.

8. The nursing bed according to claim 7, wherein the setter comprises input keys and an input display interface, the predetermined pressure value and the preset time are input by the input keys, the input predetermined pressure value and the input preset time are displayed by the input display interface.

9. The nursing bed according to claim 1, wherein the plurality of combined bed boards is in a same size and in a rectangular shape.

10. The nursing bed according to claim 1, wherein the plurality of combined bed boards is in a diamond shape, and the plurality of combined bed boards takes up a portion of the whole surface of the nursing bed.

11. The nursing bed according to claim 1, wherein the one or more pressure sensors are provided on a film carrier, the film carrier is detachably provided on the combined bed boards.

12. The nursing bed according to claim 1, wherein each of the combined bed boards is provided with at least one pressure sensor.

13. A control method of a nursing bed, used for controlling a nursing bed according to claim 1, the method comprising steps of:

comparing the pressure data transmitted by the pressure sensors with the predetermined pressure value and outputting the warning signal when the pressure data transmitted by the pressure sensors is greater than or equal to the predetermined pressure value;

with respect to each of the pressure sensors, starting timing when the warning signal is received and outputting an alarm signal when the preset time is reached; and alarming after the alarm signal is received.

14. The control method according to claim 13, wherein the step of comparing the pressure data transmitted by the pressure sensors with the predetermined pressure value and outputting the warning signal when the pressure data transmitted by the pressure sensors is greater than or equal to the predetermined pressure value further comprises outputting a normal indication signal when the pressure data is less than the predetermined pressure value.

15. The control method according to claim 14, wherein the step of with respect to each of the pressure sensors, starting timing when the warning signal is received and outputting an alarm signal when the preset time is reached further comprises stopping timing upon receiving the normal indication signal.

16. A nursing bed, comprising:

a bed body, provided with a plurality of combined bed boards, at least one of the plurality of combined bed boards is provided with one or more pressure sensors;

a comparator, connected to the one or more pressure sensors, and configured to compare pressure data transmitted by the one or more pressure sensors with a predetermined pressure value and output a warning signal when the pressure data transmitted by the one or more pressure sensors is greater than or equal to the predetermined pressure value;

a timer, connected to the comparator, and with respect to each of the pressure sensors, configured to start timing when the warning signal is received and output an alarm signal when a preset time is reached;

an alarm device, connected to the timer, and configured to give an alarm after the alarm signal is received;

a first movable board and a second movable board, rotatably connected to a left side and a right side of the bed body respectively;

a first liftable support and a second liftable support, connected to the first movable board and the second movable board respectively;

a turning over controller, connected to the comparator and configured to generate a left side turning over control signal or a right side turning over control signal upon receiving the warning signal; and a turning over driving motor, connected to the first liftable support, the second liftable support and the turning over controller, and configured to control the first movable board to move upward upon receiving the left side turning over control signal and control the second movable board to move upward upon receiving the right side turning over control signal.

17. A nursing bed, comprising:

a bed body, provided with a plurality of combined bed boards, at least one of the plurality of combined bed boards is provided with one or more pressure sensors;

a comparator, connected to the one or more pressure sensors, and configured to compare pressure data transmitted by the one or more pressure sensors with a predetermined pressure value and output a warning signal when the pressure data transmitted by the one or more pressure sensors is greater than or equal to the predetermined pressure value;

a timer, connected to the comparator, and with respect to each of the pressure sensors, configured to start timing when the warning signal is received and output an alarm signal when a preset time is reached;

an alarm device, connected to the timer, and configured to give an alarm after the alarm signal is received;

an air passage, provided under the combined bed boards;

a blower, connected to the air passage; and a blower controller, connected to the comparator and the blower, and configured to control the blower to be started upon receiving the warning signal, wherein the combined bed board is provided with a vent port.

18. The nursing bed according to claim 17, further comprising:

a blade, mounted on the vent port;

a blade controller, connected to the comparator and configured to determine a combined bed board corresponding to the warning signal upon receiving the warning signal and generate a blade starting control signal; and a blade driving motor, connected to the blade controller and the blade, and configured to control a blade of a combined bed board that corresponds to the warning signal to be opened based on the blade starting control signal.

* * * * *